US011017760B1

(12) United States Patent
Chang

(10) Patent No.: US 11,017,760 B1
(45) Date of Patent: May 25, 2021

(54) ACTIVE NOISE CANCELING APPARATUS USING MOTOR

(71) Applicants: Hyundai Motor Company, Seoul (KR); Kia Motors Corporation, Seoul (KR)

(72) Inventor: Kyoung Jin Chang, Suwon-Si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/856,837

(22) Filed: Apr. 23, 2020

(30) Foreign Application Priority Data

Nov. 1, 2019 (KR) ..... 10-2019-0138966

(51) Int. Cl.
*G10K 11/178* (2006.01)

(52) U.S. Cl.
CPC .. *G10K 11/17881* (2018.01); *G10K 11/17854* (2018.01); *G10K 11/17873* (2018.01); *G10K 11/17875* (2018.01); *G10K 2210/129* (2013.01); *G10K 2210/1282* (2013.01); *G10K 2210/3026* (2013.01); *G10K 2210/3027* (2013.01); *G10K 2210/3028* (2013.01)

(58) Field of Classification Search
None
See application file for complete search history.

(56) References Cited

U.S. PATENT DOCUMENTS

2020/0365133 A1* 11/2020 Pignier ..... G10K 11/17817
2020/0388267 A1* 12/2020 Bastyr ..... G10K 11/17837

FOREIGN PATENT DOCUMENTS

KR 10-1526602 B1 6/2015

* cited by examiner

*Primary Examiner* — Kenny H Truong
(74) *Attorney, Agent, or Firm* — Morgan, Lewis & Bockius LLP

(57) ABSTRACT

An active noise canceling apparatus using a motor may include a reference sensor configured for detecting a noise source of the vehicle; an error sensor configured for detecting information related to internal noise of the vehicle; an adaptive control circuit configured of adjusting a filter value for reducing the internal noise of the vehicle on the basis of detecting signals from the reference sensor and the error sensor, and generating a current instruction for driving the motor by applying the adjusted filter value; a motor controller configured for controlling driving of the motor to follow the current instruction; and a radiation sound generator engaged to the motor and generating sound for offsetting the internal sound using vibration generated according to the driving of the motor.

20 Claims, 10 Drawing Sheets

ACTIVE NOISE CANCELING APPARATUS USING MOTOR

CROSS REFERENCE TO RELATED APPLICATION

The present application claims priority to Korean Patent Application No. 10-2019-0138966, filed Nov. 1, 2019, the entire contents of which is incorporated herein for all purposes by this reference.

BACKGROUND OF THE INVENTION

Field of the Invention

The present invention relates to an active noise canceling apparatus using a motor, and more particularly, to an active noise canceling apparatus using a motor, the apparatus being able to actively cancel noise which is generated by noise sources in a vehicle by controlling motors variously applied to vehicles.

Description of Related Art

Recently, an active noise canceling technology that generates sound that can offset engine noise or road surface noise using a speaker disposed in the interior of a vehicle or an electric actuator disposed around an engine mount is applied to vehicles.

Such an active noise canceling technology needs several speakers, an electric actuator, and an external amplifier having a chipset requiring a high level calculation ability, so there is a defect that the manufacturing cost of a vehicle and the weight of a vehicle body increases.

The information included in the present Background of the Invention section is only for enhancement of understanding of the general background of the invention and may not be taken as an acknowledgement or any form of suggestion that the present information forms the prior art already known to a person skilled in the art.

BRIEF SUMMARY

Various aspects of the present invention are directed to providing an active noise canceling apparatus using a motor, the apparatus being able to generate structural transmission sound by controlling a motor disposed in a vehicle for a specific purpose without an additional specific actuator or external amplifier, and being able to actively cancel noise by offsetting engine noise generated in the vehicle or road surface noise.

To achieve the objectives, various aspects of the present invention are directed to providing an active noise canceling apparatus using a motor configured of generating sound for offsetting noise in a vehicle by controlling the motor mounted in the vehicle. The apparatus includes: a reference sensor configured for detecting a noise source of the vehicle; an error sensor configured for detecting information related to internal noise of the vehicle; an adaptive control circuit configured of adjusting a filter value for reducing the internal noise of the vehicle on the basis of detecting signals from the reference sensor and the error sensor, and generating a current instruction for driving the motor by applying the adjusted filter value; a motor controller configured for controlling driving of the motor to follow the current instruction; and a radiation sound generator engaged to the motor and generating sound for offsetting the internal sound using vibration generated according to the driving of the motor.

In an exemplary embodiment of the present invention, the error sensor may detect and output information related to an error between noise by the noise source and sound generated by the radiation sound generator.

In an exemplary embodiment of the present invention, the adaptive control circuit may include: an adaptive control filter configured of outputting a signal corresponding to the current instruction by filtering the detecting signal from the reference sensor; and a least mean square (LMS) controller configured of updating a filter value of the adaptive control filter on the basis of the detecting signal from the reference sensor and the detecting signal from the error sensor, the detecting signals being filtered by an estimation complementary filter configured of estimating a sound transfer function between the noise source and the error sensor.

In an exemplary embodiment of the present invention, the motor controller may include at least one of a d-q converter converting 3-phase currents of the motor measured by a current sensor into d-axial and q-axial currents; a d-q compensator compensating for d-axial and q-axial counter electromotive forces of the motor; a voltage instruction generator configured of generating d-axial or q-axial voltage instruction for driving the motor on the basis of a d-axial or q-axial current instruction value input from the adaptive control circuit, d-axial and q-axial actual current values converted through the d-q converter, and a compensation value obtained through the d-q compensator; a d-q inverse transformer converting a voltage instruction signal generated by the voltage instruction generator into three phases; and a PWM controller configured for controlling PWM signals on the basis of 3-phase voltage instruction signals converted by the d-q inverse transformer.

In an exemplary embodiment of the present invention, the apparatus may further include: a position sensor configured for detecting a position of a rotor of the motor; and an angular speed extractor extracting an angular speed of the motor on the basis of a detected position of the rotor, in which the d-q compensator may compensate for the d-axial and q-axial counter electromotive forces of the motor on the basis of an angular speed of the motor extracted by the angular speed extractor, d-axial and q-axial inductances, d-axial and q-axial current instruction values, and magnetic flux of the motor.

In an exemplary embodiment of the present invention, the PWM controller may be Space vector pulse width modulation (SVPWM) or Sinusoidal pulse width modulation (SPWM).

In an exemplary embodiment of the present invention, the apparatus may further include an inverter including a plurality of switching elements and driving the motor by providing AC power to the motor by turning on or off the switching elements in a response to PWM signals output from the PWM controller.

In an exemplary embodiment of the present invention, the motor may be a motor-driven power steering (MDPS) motor which is connected to a steering wheel shaft mounted in the vehicle and assists a steering wheel to steer.

In an exemplary embodiment of the present invention, the radiation sound generator may include: a motor support structure connected to the motor and transmitting vibration generated from the motor; a mounting bracket fixing the motor support structure; and a radiation sound generation panel generating the sound using vibration of the motor transmitted through the mounting bracket.

In an exemplary embodiment of the present invention, the radiation sound generator may further include a frequency tuning structure attached to the radiation sound generation panel and adjusting a frequency of sound generated from the radiation sound generation panel.

According to the active noise canceling apparatus using a motor, it is possible to actively cancel noise by controlling a motor disposed in advance in a vehicle without adding a specific actuator and an external amplifier for canceling noise in a vehicle, and accordingly, it is possible to reduce the entire weight and manufacturing cost of a vehicle.

The methods and apparatuses of the present invention have other features and advantages which will be apparent from or are set forth in more detail in the accompanying drawings, which are incorporated herein, and the following Detailed Description, which together serve to explain certain principles of the present invention.

The effects of the present invention are not limited to the effects described above and other effects may be clearly understood by those skilled in the art from the following description.

Figure 1:
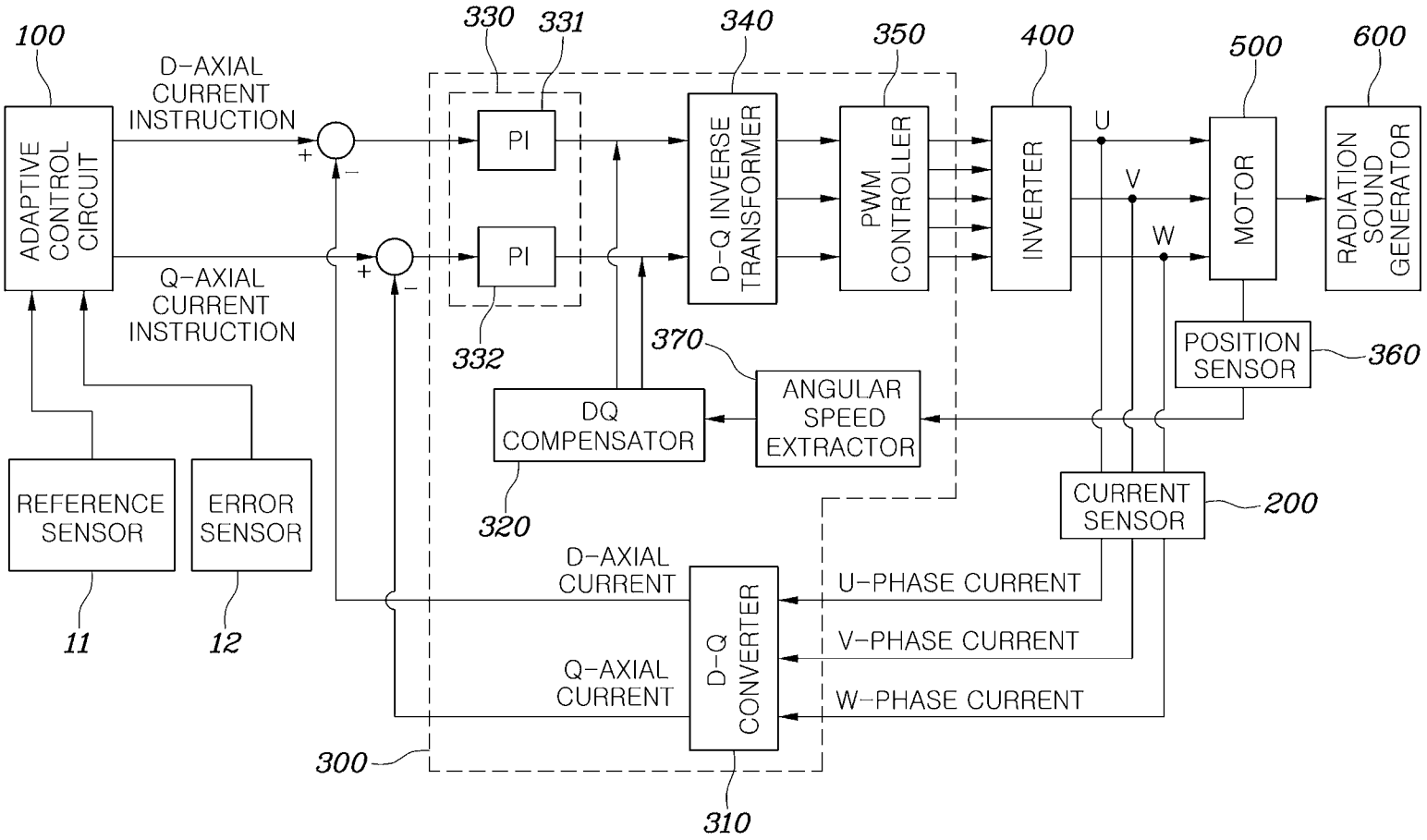
FIG. 1 is a block schematic diagram showing an active noise canceling apparatus using a motor according to an exemplary embodiment of the present invention.

It may be understood that the appended drawings are not necessarily to scale, presenting a somewhat simplified representation of various features illustrative of the basic principles of the present invention. The specific design features of the present invention as included herein, including, for example, specific dimensions, orientations, locations, and shapes will be determined in portion by the intended application and use environment.

In the figures, reference numbers refer to the same or equivalent portions of the present invention throughout the several figures of the drawing.

DETAILED DESCRIPTION

Reference will now be made in detail to various embodiments of the present invention(s), examples of which are illustrated in the accompanying drawings and described below. While the present invention(s) will be described in conjunction with exemplary embodiments, it will be understood that the present description is not intended to limit the present invention(s) to those exemplary embodiments. On the other hand, the present invention(s) is/are intended to cover not only the exemplary embodiments, but also various alternatives, modifications, equivalents and other embodiments, which may be included within the spirit and scope of the present invention as defined by the appended claims.

Hereafter, an active noise canceling apparatus using a motor according to Various embodiments of the present invention is described in detail with reference to the accompanying drawings.

The present invention is described in detail with reference to the drawings. The terms and words used In an exemplary embodiment of the present invention and claims may not be interpreted as being limited to typical meanings or dictionary definitions, but may be interpreted as having meanings and concepts relevant to the technical scope of the present invention based on the rule according to which an inventor can appropriately define the concept of the term to describe most appropriately the best method the or she knows for carrying out the present invention.

Therefore, the configurations described in the exemplary embodiments and drawings of the present invention are merely most preferable embodiments but do not represent all of the technical spirit of the present invention. Thus, the present invention may be construed as including all the changes, equivalents, and substitutions included in the spirit and scope of the present invention at the time of filing the present application.

Figure 2:
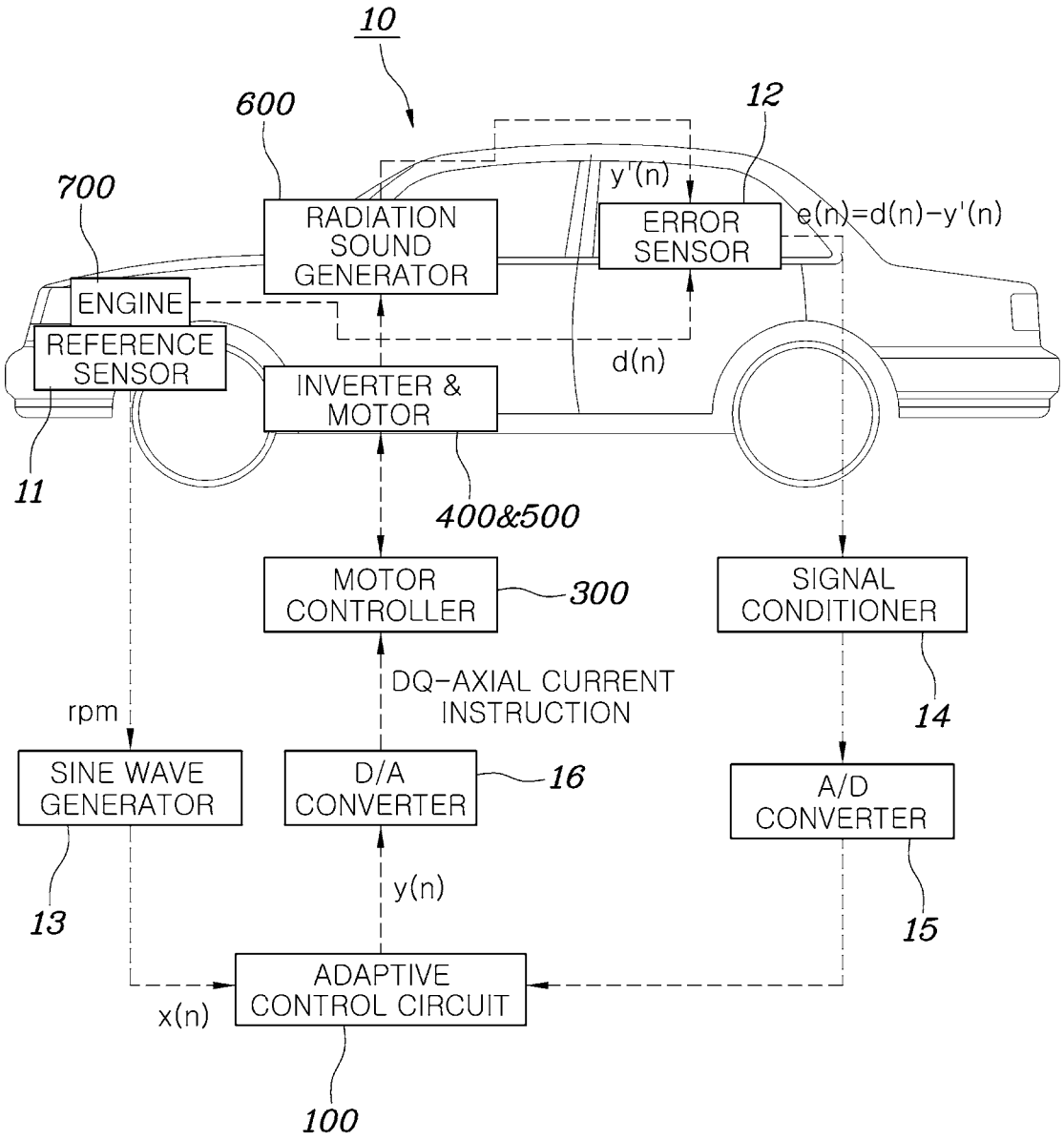
FIG. 2 is a schematic diagram showing a signal input/output relationship of an adaptive control circuit in an active noise canceling apparatus using a motor according to an exemplary embodiment of the present invention.

FIG. 1 is a block schematic diagram showing an active noise canceling apparatus using a motor according to an exemplary embodiment of the present invention and FIG. 2 is a schematic diagram showing a signal input/output relationship of an adaptive control circuit in an active noise canceling apparatus using a motor according to an exemplary embodiment of the present invention.

Referring to FIG. 1 and FIG. 2, an adaptive control circuit in an active noise canceling apparatus using a motor according to an exemplary embodiment of the present invention may include a reference sensor 11, an error sensor 12, an adaptive control circuit 100, a current sensor 200, a motor controller 300, an inverter 400, a motor 500, a radiation sound generator 600.

The reference sensor 11 is a sensor which is installed on a noise source, which generates noise traveling to the interior of a vehicle 10, and detects operation information related to the noise source. For example, for engine noise, the reference sensor 11 may be an rpm sensor that detects the rpm of an engine 700. As an exemplary embodiment of the present invention, for road surface noise, the reference sensor 11 may be an acceleration sensor that detects an acceleration signal of a suspension of a wheel.

The error sensor 12, which is a sensor that directly detects noise in the vehicle, may be a microphone that detects a sound pressure signal in the vehicle. Information detected by the error sensor 12 may correspond to an error between noise traveling to the interior of the vehicle from a noise source and sound generated by the radiation sound generator 600 that generates sound using vibration generated by controlling a motor 500 to cancel the noise.

The adaptive control circuit 100 can receive sensor signals from the reference sensor 11 and the error sensor 12, can update a filter value of an adaptive control filter by applying an adaptive control algorithm stored in advance, using the received sensor signals, and can provide a current instruction signal to the motor controller 300 that controls the motor 500 from the adaptive control filter with the updated filter value. That is, the adaptive control circuit 100 may include an adaptive control algorithm for updating the filter value of the adaptive filter using the adaptive control filter and the sensor signals.

As shown in FIG. 2, as for the signal input/output process of the active control circuit 100, first, a signal e(n) measured by the error sensor 12 such as a microphone attached in a vehicle may be input to the adaptive control circuit 100 through a signal conditioner 14 and an analog/digital (A/D) converter 15. Furthermore, an rpm signal of the engine 700 detected by the reference sensor 11 disposed on the engine 700 is converted into a reference signal x(n) of sine wave corresponding to the rpm of the engine 700 through a sine wave generator 13 and is then input to the adaptive control circuit 100.

The adaptive control circuit 100 performs a series of calculations for active noise canceling, using the adaptive control algorithm therein (a calculation technique through the adaptive control algorithm is described below), and then the calculation result is provided as a d-axial current instruction and a q-axial current instruction to the motor controller 300 through a digital/analog (D/A) converter 16. The motor controller 300 drives an inverter 400 and the motor 500 using the d-axial current instruction and the q-axial current instruction.

When the motor 500 is driven, the motor 500 generates d-axial or q-axial vibration and active sound is generated from the radiation sound generator 600 by the vibration. The active sound is transmitted to the internal while canceling existing engine sound, the error sensor 12 detects and transmits a component remaining after canceling back to the adaptive control circuit 100, and the adaptive control circuit 100 gradually decrease engine noise detected in the interior of the vehicle by repeating the process described above at every sampling.

An axis for generating and using vibration of the motor 500 for active noise control may be selected from the d-axis and the q-axis. The d-axis and the q-axis respectively mean the axes for the direction of centrifugal force and the rotation direction of the motor 500 and are provided to convert and control three phases of a 3-phase inverter, which applies driving power to the motor 500, into two orthogonal coordinate axes. In general, the q-axis requires using the intrinsic function of a motor by controlling motor torque, so it is advantageous to use the d-axis to generate sound by generating vibration. However, the q-axis may also be used to generate sound by generating vibration.

Figure 3:
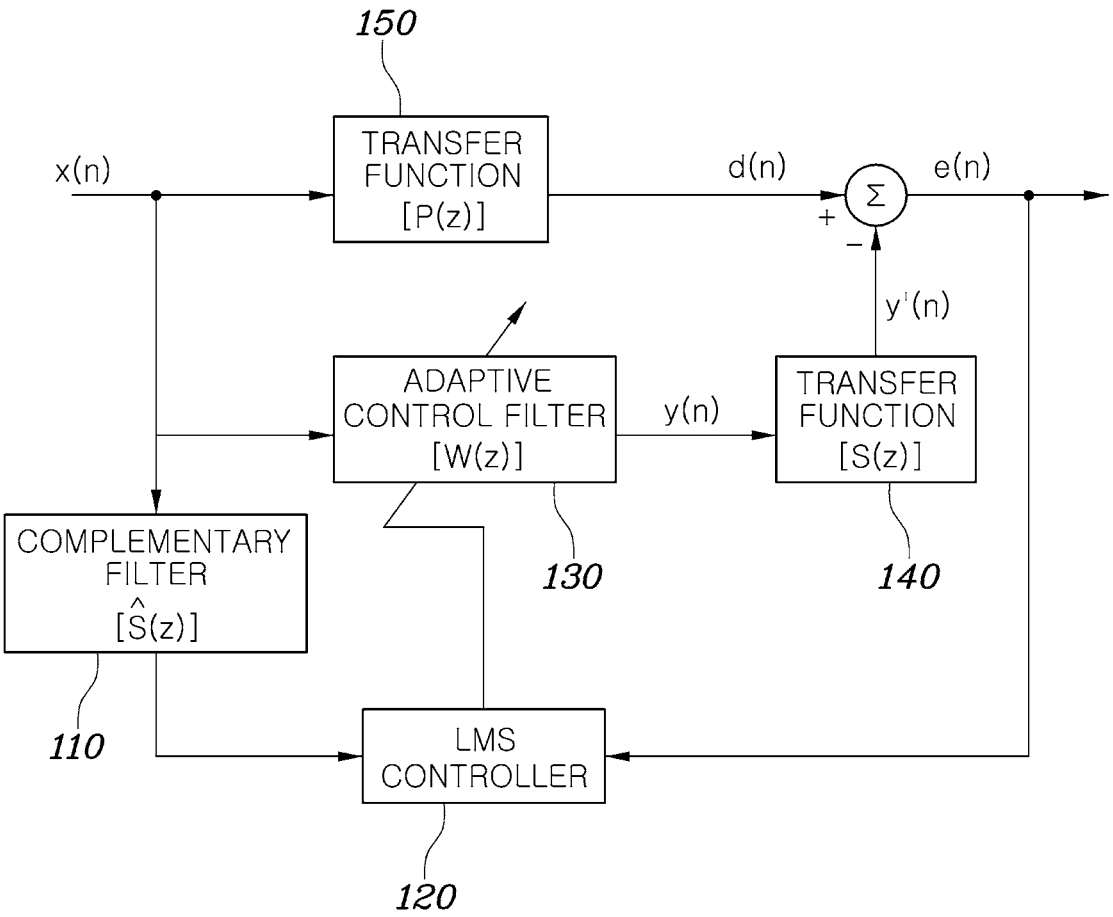
FIG. 3 is a block diagram showing an example of an adaptive control algorithm applied to the active control circuit in an active noise canceling apparatus using a motor according to an exemplary embodiment of the present invention.

FIG. 3 is a block diagram showing an example of an adaptive control algorithm applied to the active control circuit in an active noise canceling apparatus using a motor according to an exemplary embodiment of the present invention.

As the adaptive control algorithms which may be applied to the adaptive control circuit 100, there are various algorithms such as Filtered-input least mean square (FxLMS), Filtered-input normalized least mean square (FxNLMS), Filtered-input recursive least square (FxRLS), and Filtered-input normalized recursive least square (FxNRLS), the example shown in FIG. 3 is a narrow band FxLMS algorithm which is used to reduce engine noise.

A reference signal x(n) may be obtained by an rpm sensor which is the reference sensor 11 disposed on the engine 700. As described with reference to FIG. 2, a reference signal x(n) of a sine wave type may be generated by applying the sine wave generator 13 to a signal detected by the rpm sensor.

The reference signal x(n) is input to an LMS controller 120 through an estimation complementary filter ($\hat{S}(z)$) 110 of a transfer function between the motor and the error sensor 12. Furthermore, an error signal e(n), which corresponds to the error between the sound traveling to the interior of the vehicle from the engine 700 and active sound y'(n) generated by the radiation sound generator 600 is also input to the LMS controller 120.

Next, the LMS controller 120 updates the filter value of the adaptive control filter W(z) 130 such that the adaptive control filter W(z) 130 determines and outputs a signal y(n) corresponding to a current instruction value, and the output signal is input to the motor controller 300 through the D/A converter 16. In the instant case, the filter value update formula which is performed by the LMS controller 120 is as follows.

$$e(n)=d(n)-y'(n)$$

$$W(n+1)=W(n)+\mu\cdot e(n)\cdot x'(n)$$

$$y(n)=W(n)*x(n) \qquad \text{[Formula 1]}$$

In the Formula 1, 'μ' is a step size, '*' is a sum of convolution and 'y' is a control output.

On the other hand, the technique of modeling the complementary filter ($\hat{S}(z)$) 110 that estimates the transfer function (S(z)) between the motor and the error sensor in the adaptive control algorithm described above is as follows.

When a microphone in the interior of a vehicle is used as the error sensor 12, it is required to model a complementary filter by estimating a secondary path through which an exciting force generated from the motor 500 generates vibration of the radiation sound generator 600 and the vibration is transmitted as noise to the error sensor 12 through the structure of the vehicle and air, and to the present end, it is required to obtain 'internal sound pressure A/exciting force F of motor'. If an accelerometer is used as the error sensor 12, 'vibration V of radiation sound generation structure/exciting force F of motor' may be used as a secondary path transfer function complementary filter.

Meanwhile, it is required to model h(t) which is an impulse response function of output t/input t in both cases described above, and there are various methods for modeling it.

First, it is possible to obtain a frequency response function of input and output and then can obtain h(t) through Fast Fourier Transform (FFT) inverse transform. In the instant case, the frequency response function of input and output may be induced as several formulae, depending on which one of the input and the output has much noise component.

Other than these methods, h(t) may be obtained by expressing the numerator and the denominator of the transfer function of input and output into a polynomial function, performing curve fitting with the numbers of poles and zeroes assumed, and then performing FFT inverse transform.

These methods are consequently for canceling noise of input and output and performing modeling to explain best the actual physical phenomenon of a system, and may be implemented by selecting and modeling an appropriate method by an engineer in the corresponding filed.

The current sensor 200 detects the currents of the phases of the motor 500. Furthermore, the currents of the phases detected by the current sensor 200 may be converted into d-axial current and q-axial current by being input to a d-q converter 310.

The motor controller 300 can generate a voltage instruction for driving the motor 500 so that sound is generated, on the basis of a current instruction generated by the adaptive control circuit 100, the actual current information related to the motor 500 detected by the current sensor 200, and a counter electromotive force compensation value of the motor 500, and can control driving of the motor 500.

Figure 4:
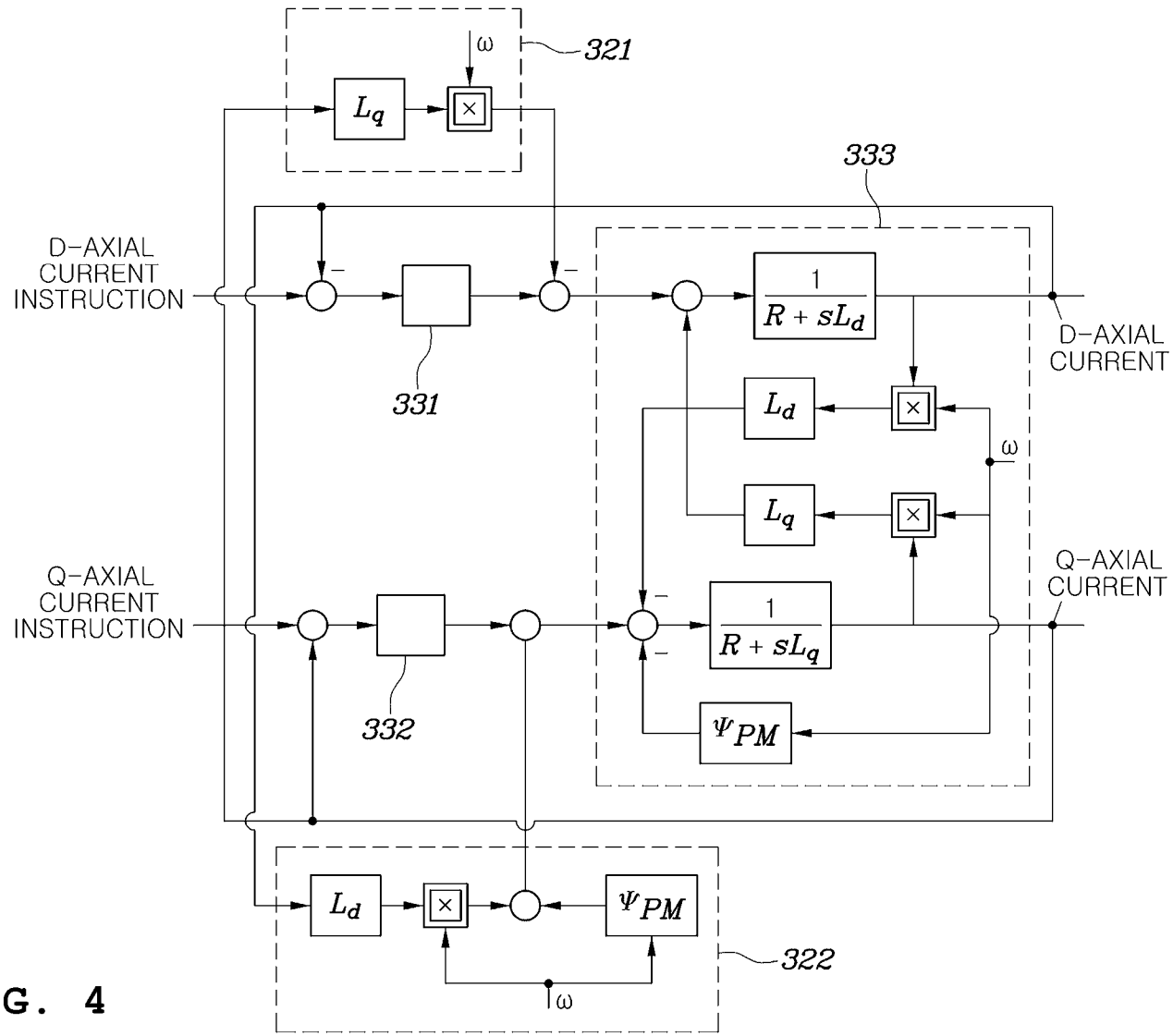
FIG. 4 is a block diagram showing the detailed configuration of a motor controller in an active noise canceling apparatus using a motor according to an exemplary embodiment of the present invention.

FIG. 4 is a block diagram showing the detailed configuration of a motor controller in an active noise canceling apparatus using a motor according to an exemplary embodiment of the present invention.

Referring to FIGS. 1 and 4, the motor controller 300 may include at least one of a d-q converter 310, a d-q compensator 320, a voltage instruction generator 330, a d-q inverse transformer 340, and a pulse-width modulation (PWM) controller 350. The motor controller 300 may further include a position sensor 360 that detects the position of the rotor of the motor 500 and an angular speed extractor 370 that extracts the angular speed of the motor 500 on the basis of the detected position of the rotor. Depending on embodiments, a Hall sensor, an encoder, or a resolver may be used as the position sensor 360 that detects the position of the rotor.

In more detail, the d-q converter 310 converts 3-phase currents of the motor 500 measured by the current sensor 200 into d-axial and q-axial currents. The phase conversion of converting the 3-phase currents of the motor 500 into d-axial current and q-axial current is a well-known technique, so that the detailed description is omitted.

The d-q compensator 320 compensates for d-axial and q-axial counter electromotive forces of the motor 500. In detail, the d-q compensator 320 can compensate for the d-axial and q-axial counter electromotive forces of the motor 500 on the basis of the angular speed of the motor 500 extracted by the angular speed extractor 370, the d-axial and q-axial inductances, the d-axial and q-axial current instruction values, and the magnetic flux of the motor.

In detail, the d-q compensator 320 can compensate for the d-axial and q-axial counter electromotive forces of the motor 500 as feed-forward compensator. In the instant case, the d-q compensator 320 may include a d-axial compensator 321 and a q-axial compensator 322. In more detail, the compensation values for the d-axial and q-axial counter electromotive forces of the motor may be determined from the following Formula 2.

$$V_{d_ref_ff}=-\omega_r L_q i_{q_ref}$$

$$V_{q_ref_ff}=\omega_r(L_d i_{d_ref}+\Psi_{pm}) \quad \text{[Formula 2]}$$

where $V_{d_ref_ff}$ is a voltage instruction value of the d-axial feed-forward compensator, $V_{q_ref_ff}$ is a voltage instruction value of the q-axial feed-forward compensator, $\omega_r$ is the angular speed of the motor, $L_q$ and $L_d$ are q-axial and d-axial inductances, respectively, $i_{q_ref}$ and $i_{d_ref}$ are q-axial and d-axial current instructions values, respectively, and $\Psi_{pm}$ is the magnetic flux of the motor.

The voltage instruction generator 330 can generate a d-axial or q-axial voltage instruction for generating sound by driving the motor 500 on the basis of a d-axial or q-axial current instruction value input from the adaptive control circuit 100, d-axial and q-axial actual current values converted through the d-q converter 310, and a compensation value obtained through the d-q compensator 320.

In detail, the voltage instruction generator 330 may include proportional integral controllers 331 and 332 that performs proportional integral control on the d-axial or q-axial current instruction value input from the adaptive control circuit 100 and the -axial and q-axial actual current values converted through the d-q converter 310. In the instant case, the voltage instruction generator 330 may include the proportional integral controllers 331 and 332 for the d-axis and the q-axis, respectively.

Furthermore, as for the d-axis, the voltage instruction generator 330, as shown in FIG. 4, can generate a d-axial voltage instruction signal for generating sound by driving the motor 500 by subtracting a d-axial counter electromotive force compensation value derived through the d-q compensator 320 from an output value of the d-axial proportion integral controller 331 and then by inputting a resultant value to an RL circuit 333 of the motor 500.

Furthermore, as for the q-axis, the voltage instruction generator 330, as shown in FIG. 4, can generate a q-axial voltage instruction signal for generating sound by driving the motor 500 by summing a q-axial counter electromotive force compensation value derived through the d-q compensator 320 and an output value of the q-axial proportion integral controller 331 and then by inputting a resultant value to an RL circuit 333 of the motor 500.

The d-q inverse transformer 340 converts a voltage instruction signal generated by the voltage instruction generator 330 into three phases. The d-q inverse transformer 340 can inversely convert a 2-phase d-axial or q-axial voltage instruction signal generated by the voltage instruction generator 330 into a signal in a 3-phase coordinate system to apply the signal to the motor 500. In the instant case, converting 2-phase d-axial and q-axial signals into 3-phase signals is a well-known technique, so that the detailed description is omitted.

The PWM controller 350 can control a PWM signal on the basis of the 3-phase voltage instruction signal converted through the d-q inverse transformer 340.

In detail, the PWM controller 350 can generate and control a PWM signal, which is applied to a switching element included in the inverter 400 to be described below on the basis of the 3-phase voltage instruction signal output from the d-q inverse transformer 340, in order that a desired current is input to the motor 500. Depending on embodiments, the PWM controller 350 may be Space vector pulse width modulation (SVPWM) or Sinusoidal pulse width modulation (SPWM). Generating and controlling a PWM signal in SVPWM or SPWM is a well-known technique, so that the detailed description is omitted.

The inverter 400 includes a plurality of switching elements and the switching elements are turned on/off in a response to PWM signals output from the PWM controller 350, whereby AC power is provided to the motor 500 and the motor 500 may be driven.

The motor 500, which is a permanent magnet synchronous motor (PMSM), may be a motor which is connected to a steering wheel shaft 700 mounted in a vehicle and assists a steering wheel to steer. Depending on embodiments, the motor 500 may be a motor-driven power steering (MDPS) motor.

The radiation sound generator 600 generates sound by vibration generated from the motor 500 driven by the motor controller 300.

Several embodiments of the present invention are implemented in the principle in which an exciting force to the motor 500, the exciting force is transmitted to the radiation sound generator 600 through a mounting that supports the motor 500 and amplifies sound in the radiation sound generator 600, and then the exciting force for the motor is controlled by applying an adaptive control algorithm such as an FxLMS algorithm to a signal obtained by detecting internal noise by the adaptive control circuit 100, reducing engine noise of the vehicle, etc.

In the instant case, the direction in which the exciting force is generated may be the rotation direction or the centrifugal direction of the motor, but the rotation direction of the motor is required for the intrinsic function of the motor, so it is preferable to generate the exciting force in the centrifugal direction of the motor. The exciting force generated in the motor 500 causes structure borne sound and noise in the vehicle may be offset by the structure borne sound.

For example, it was found that contribution of airborne sound to motor-driven power steering (MDPS) which is applied to the steering column of a vehicle is very small, the transmission path of the structure borne sound may be divided into first a path going to a gear box mounting structure through a gear box, second a path going to a steering wheel through a steering column, and third a path going to a radiation sound generation structure through a steering column mounting, and it was found through a test that the contribution of the third path is the largest. In an exemplary embodiment of the present invention of the present invention, the structure of the radiation sound generator 600 may be designed so that structure borne sound may be minimized using the third path.

Figure 5:
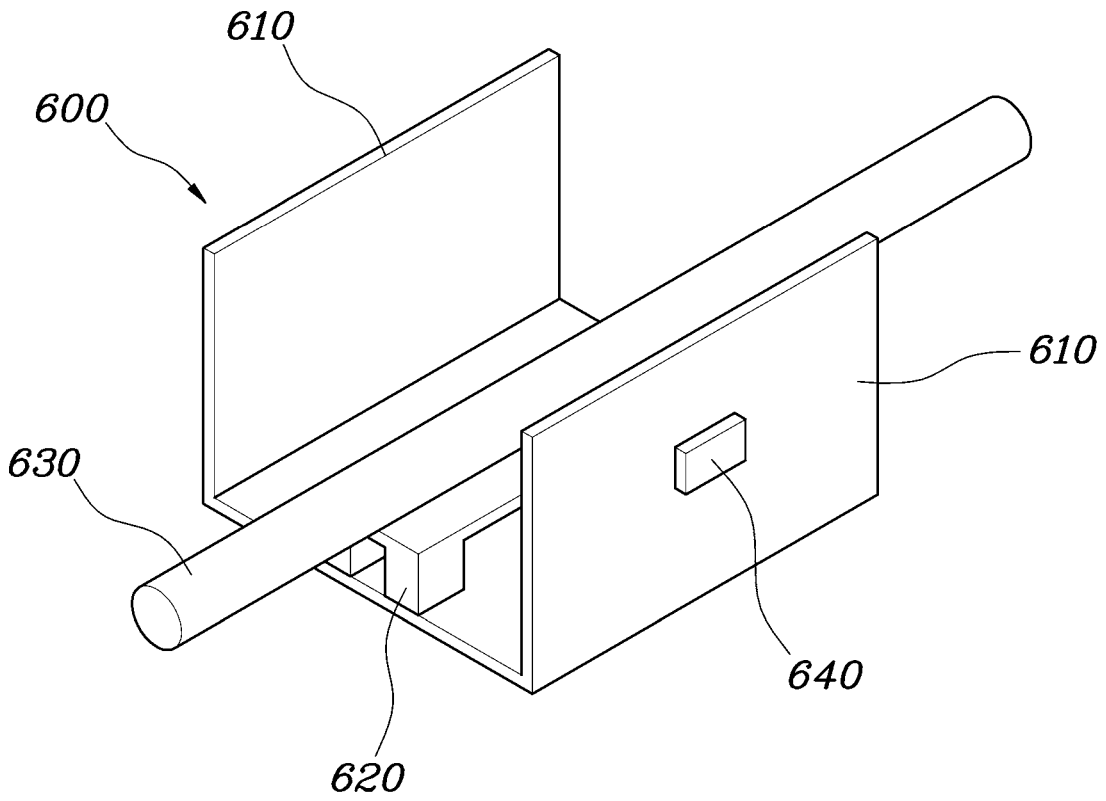
FIG. 5 is a perspective view a radiation sound generator of an active noise canceling apparatus using a motor according to an exemplary embodiment of the present invention.
Figure 6:
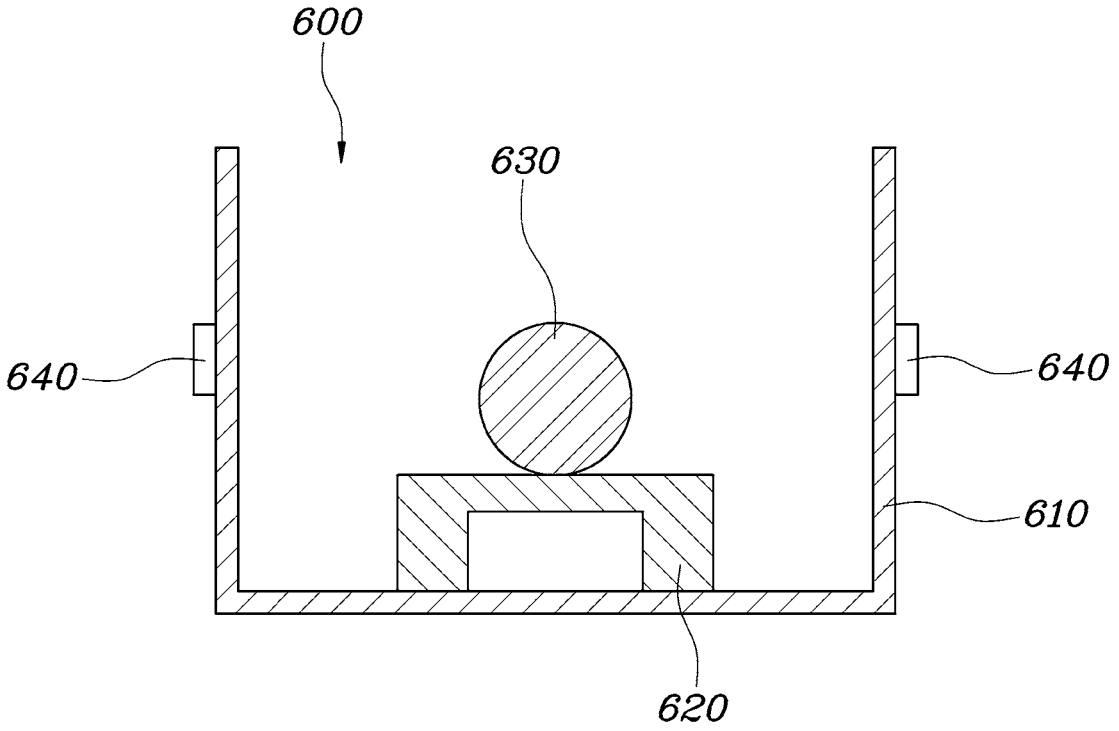
FIG. 6 is a cross-sectional view the radiation sound generator of an active noise canceling apparatus using a motor according to an exemplary embodiment of the present invention.

FIG. 5 is a perspective view a radiation sound generator of an active noise canceling apparatus using a motor according to an exemplary embodiment of the present invention and FIG. 6 is a cross-sectional view the radiation sound generator of an active noise canceling apparatus using a motor according to an exemplary embodiment of the present invention.

Referring to FIG. 5 and FIG. 6, the radiation sound generator 600 may include a motor support structure 630 which is connected to the motor 500 and transmits vibration generated from the motor 500, a mounting bracket 620 that fixes the motor support structure 630, and a radiation generation panel 610 to which the mounting bracket 620 is fixed, and that generates radiation sound using vibration of the motor 500 which is transmitted through the motor support structure 630 and the mounting bracket 620.

When vibration of the motor 500 is transmitted through the motor support structure 630 and the mounting bracket 620, the radiation sound generation panel 610 vibrates and generates large sound. Furthermore, the frequency of the radiation sound generation panel 610 may be tuned using the thickness of the panel and a frequency tuning structure 640 attached to the panel so that vibration-sound sensitivity increases at a specific frequency.

The frequency tuning structure 640 increases the vibration-sound sensitivity of the radiation generation panel at a low frequency as applied weight increases, and when it is formed in a rib shape and then attached, it increases the rigidity of the panel, being able to increase the vibration-sound sensitivity of the radiation sound generation panel at a high frequency.

Furthermore, in order that the radiation sound generation panel 610 generates sound with a sufficient volume to be configured to offset noise from a control target, it is required to design dynamic impedance of the radiation sound generation structure to be low in comparison to the mounting bracket 620 to which vibration is transmitted.

In general, it is required to increase dynamic impedance at the part receiving vibration to reduce noise and vibration, but it is required to generate large noise and vibration in several embodiments of the present invention, so it is required to design dynamic impedance at the part receiving vibration to be low and it is required to design the surface radiation efficiency of the radiation sound generator 600 to be high so that radiation sound becomes loud. To this end, the thickness of the panel may be designed to be smaller than the thickness of the mounting bracket 620 and a material having small mass but being relatively hard may be used. Furthermore, a surface area may be designed to be as wide as possible as long as it is permitted by a given layout.

FIG. 7, FIG. 8, FIG. 9 and FIG. 10 are graphs showing test results for checking a noise canceling effect of an active noise canceling apparatus using a motor according to an exemplary embodiment of the present invention.

The test performed to derive the result shown in FIG. 7, FIG. 8, FIG. 9 and FIG. 10 was a test performed by manufacturing an active noise canceling apparatus using a Motor-driven power steering (MDPS) motor of a column attachment type that performs a steering function through a steering wheel as one of motors in a vehicle.

A test of canceling the original noise by mounting a speaker at a positions spaced rearward apart from a test device, generating predetermined noise, receiving an error signal through a microphone disposed ahead of the test device while inputting the frequency of the original noise as a reference signal, driving an MDPS motor using the adaptive control circuit and the motor control circuit according to an exemplary embodiment of the present invention, and generating sound from the radiation sound generator using vibration excited by the MDPS motor was performed. In the instant case, the original noise was freely set as a sine wave of 50 Hz, the sampling frequency of the control circuit was set as 500 Hz, and the number of adaptive control filters was set as two (W1 and W2) to control the magnitude and phase of the sine wave of 50 Hz.

Figure 7:
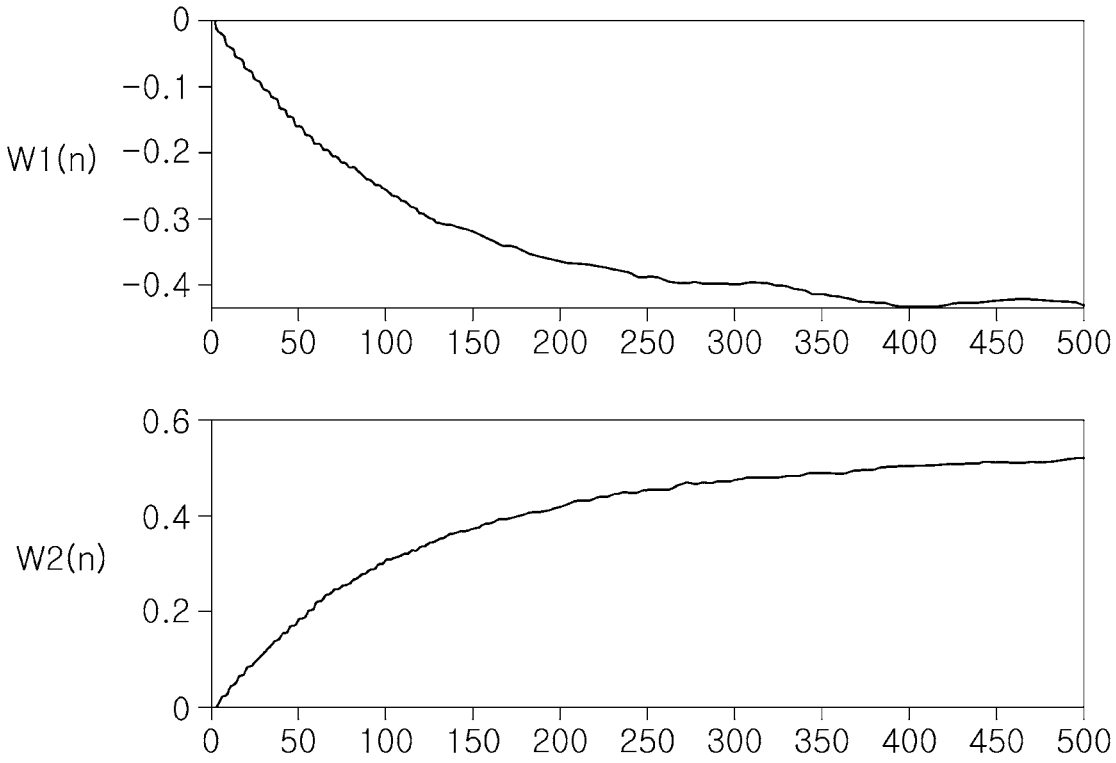
FIG. 7, FIG. 8, FIG. 9 and FIG. 10 are graphs showing test results for checking a noise canceling effect of an active noise canceling apparatus using a motor according to an exemplary embodiment of the present invention.
Figure 8:
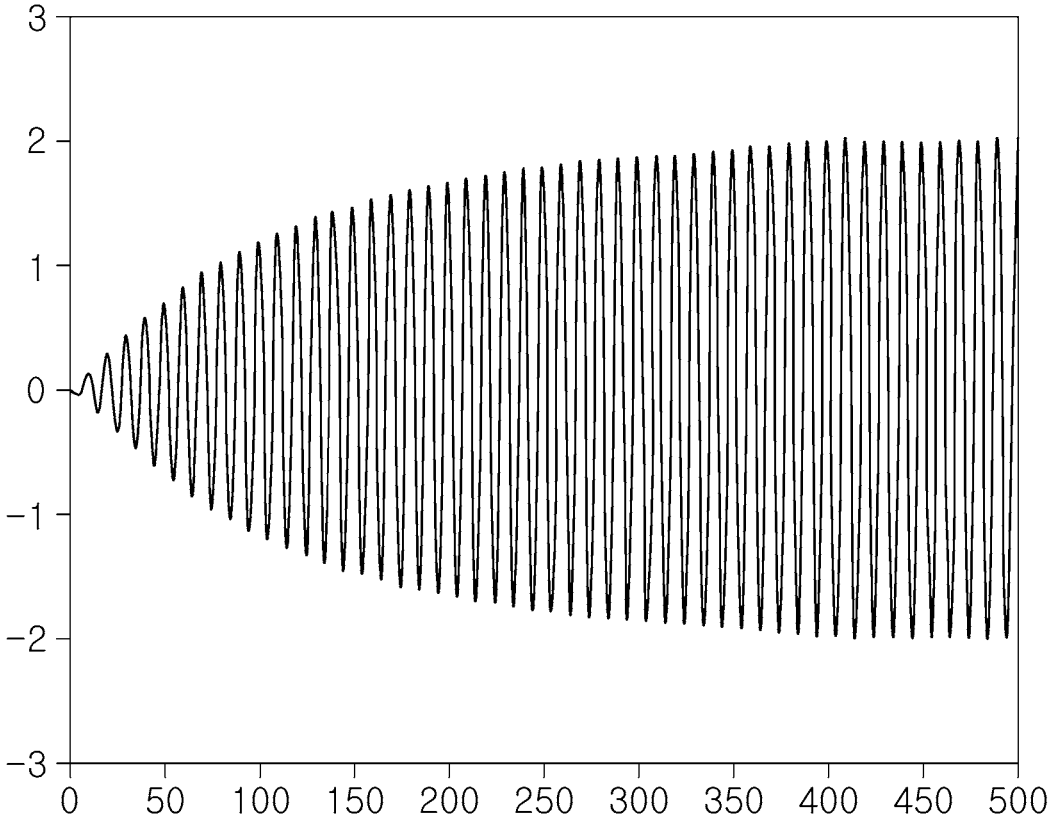
Figure 9:
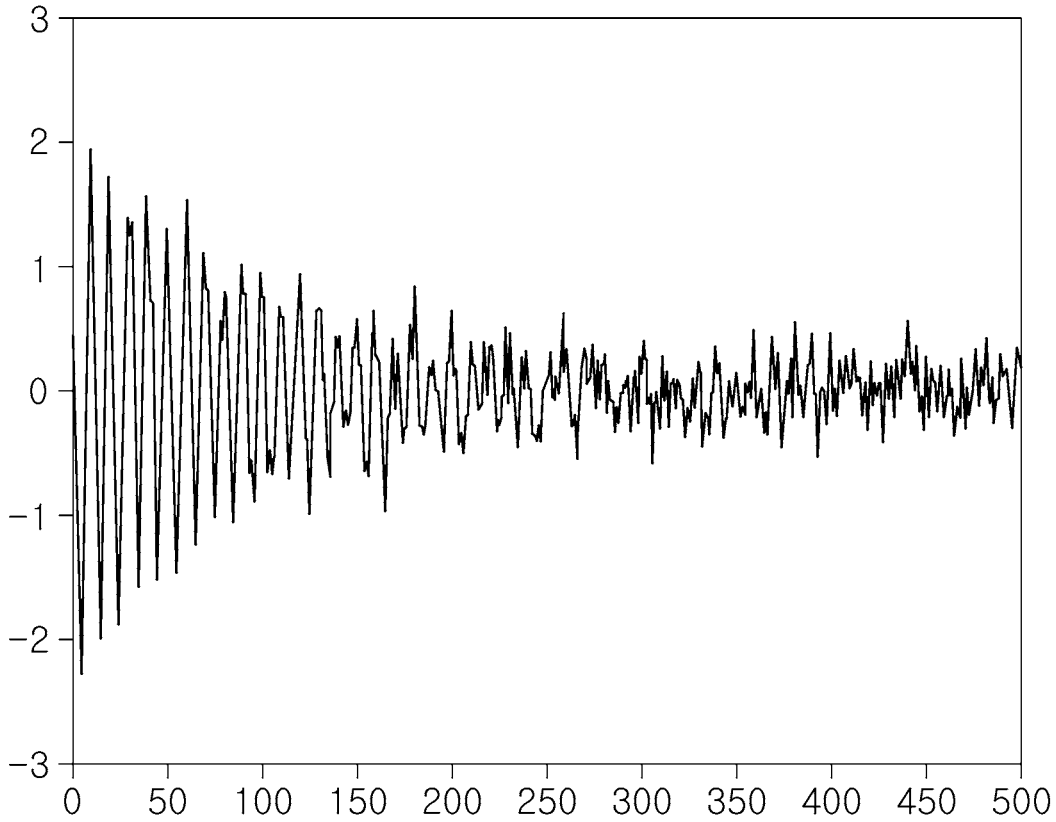
Figure 10:
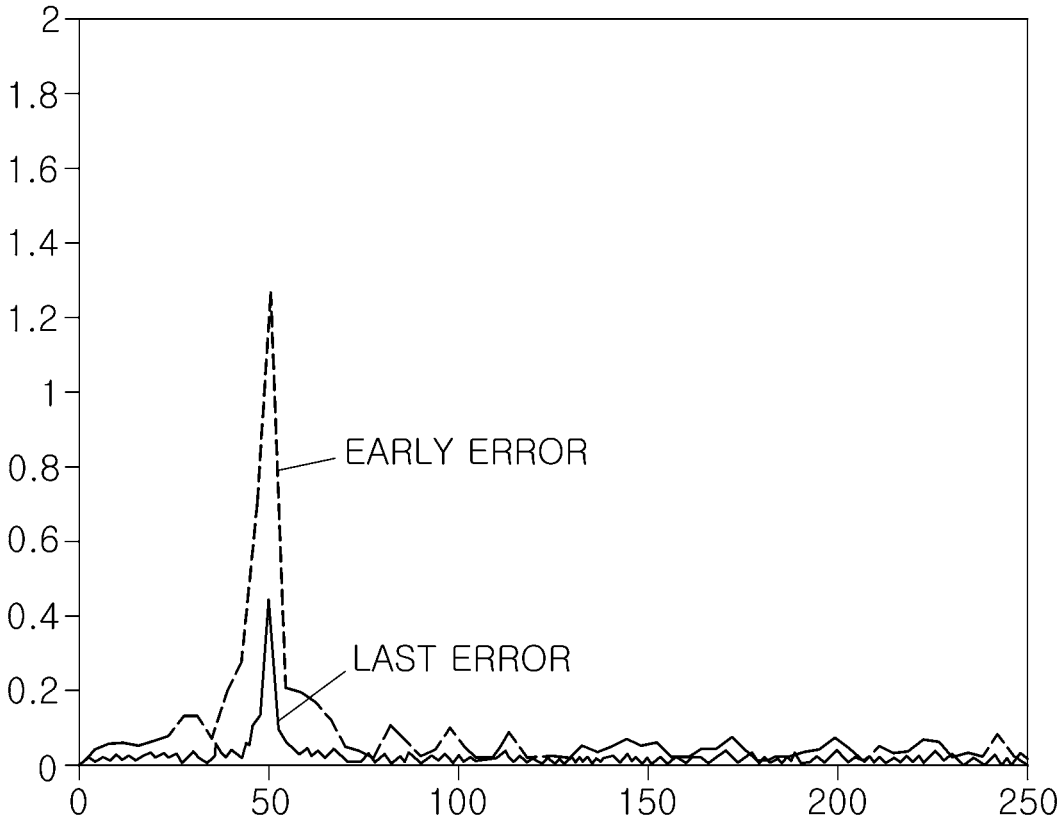

The x-axes of W1($n$) and W2($n$) shown in FIG. 7, y(n) shown in FIG. 8, and e(n) shown in FIG. 9 correspond to the every number of times of sampling and show results when control was performed for a total of one second. Referring to the results shown in FIG. 7, FIG. 8, FIG. 9 and FIG. 10, it may be seen that the filter values W1($n$) and W2($n$) shown in FIG. 7 were updated every time and then decreased in change after the number of times of sampling of about 200, the control output y(n) shown in FIG. 8 was also decreased in change after the number of times of sampling of about 200, and the error signal e(n) shown in FIG. 9 was gradually decreased from the magnitude of about 2 in the early stage and then converted to values of 0.2~0.6 after the number of times of sampling of about 200. It is determined that the error was no more decreased because of the influence by noise existing other than noise from control targets. Furthermore, FIG. 10 shows the result of converting 50 data of error signals e(n) in the early stage and the later stage of control using FFT and then comparing the error signals at a frequency domain in the early stage and the later stage of control, in which it was shown that the magnitude of noise of 50 Hz which is the control target noise decreased by about 65% from 1.26 to 0.44 through an exemplary embodiment of the present invention.

As described above, the active noise canceling apparatus using a motor according to several embodiments of the present invention can actively cancel noise by controlling a motor disposed in advance in a vehicle without adding a specific actuator and an external amplifier for canceling noise. Accordingly, the active noise canceling apparatus using a motor according to several embodiments of the present invention can actively cancel noise in a vehicle while reducing the entire weight and manufacturing cost of a vehicle.

For convenience in explanation and accurate definition in the appended claims, the terms "upper", "lower", "inner", "outer", "up", "down", "upwards", "downwards", "front", "rear", "back", "inside", "outside", "inwardly", "outwardly", "internal", "external", "inner", "outer", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. A noise canceling apparatus using a motor for generating sound for offsetting noise in a vehicle by controlling the motor mounted in the vehicle, the apparatus comprising:

a reference sensor configured for detecting a noise source of the vehicle;

an error sensor configured for detecting information related to internal noise of the vehicle;

an adaptive control circuit connected to the reference sensor and the error sensor and configured of adjusting a filter value for reducing the internal noise of the vehicle on a basis of detecting signals from the reference sensor and the error sensor and of generating a current instruction for driving the motor by applying the adjusted filter value;

a motor controller connected to the motor and the adaptive control circuit and configured for controlling driving of the motor to follow the current instruction; and a radiation sound generator engaged to the motor and generating the sound for offsetting the internal sound using vibration generated according to the driving of the motor.

2. The apparatus of claim 1, wherein the error sensor is configured to detect and output information related to an error between noise by the noise source and the sound generated by the radiation sound generator.

3. The apparatus of claim 1, wherein the adaptive control circuit includes:

an adaptive control filter configured of outputting a signal corresponding to the current instruction by filtering the detecting signal from the reference sensor; and a least mean square (LMS) controller configured of updating the filter value of the adaptive control filter on a basis of the detecting signal from the reference sensor and the detecting signal from the error sensor, the detecting signals being filtered by an estimation complementary filter configured of estimating a sound transfer function between the noise source and the error sensor.

4. The apparatus of claim 1, wherein the motor controller includes at least one of a d-q converter converting 3-phase currents of the motor measured by a current sensor into d-axial and q-axial currents;

a d-q compensator compensating for d-axial and q-axial counter electromotive forces of the motor;

a voltage instruction generator configured of generating d-axial or q-axial voltage instruction for driving the motor on a basis of a d-axial or q-axial current instruction value input from the adaptive control circuit, d-axial and q-axial actual current values converted through the d-q converter, and a compensation value obtained through the d-q compensator;

a d-q inverse transformer converting a voltage instruction signal generated by the voltage instruction generator into three phases; and a pulse-width modulation (PWM) controller configured for controlling PWM signals on a basis of 3-phase voltage instruction signals converted by the d-q inverse transformer.

5. The apparatus of claim 4, further including:

a position sensor configured for detecting a position of a rotor of the motor; and an angular speed extractor extracting an angular speed of the motor on a basis of a detected position of the rotor, wherein the d-q compensator is configured to compensate for the d-axial and q-axial counter electromotive forces of the motor on a basis of an angular speed of the motor extracted by the angular speed extractor, d-axial and q-axial inductances, d-axial and q-axial current instruction values, and magnetic flux of the motor.

6. The apparatus of claim 4, wherein the PWM controller is space vector pulse width modulation (SVPWM) or sinusoidal pulse width modulation (SPWM).

7. The apparatus of claim 4, further including:

an inverter connected to the PWM controller and including a plurality of switching elements and driving the motor by providing AC power to the motor by turning on or off the plurality of switching elements in a response to PWM signals output from the PWM controller.

8. The apparatus of claim 1, wherein the motor is a motor-driven power steering (MDPS) motor which is connected to a steering wheel shaft mounted in the vehicle and assists a steering wheel to steer.

9. The apparatus of claim 1, wherein the radiation sound generator includes:

a motor support structure connected to the motor and transmitting the vibration generated from the motor;

a mounting bracket fixing the motor support structure and receiving the vibration generated from the motor; and a radiation sound generation panel coupled to the mounting bracket and generating the sound using the vibration of the motor transmitted through the mounting bracket.

10. The apparatus of claim 9, wherein the radiation sound generator further includes a frequency tuning structure attached to the radiation sound generation panel and adjusting a frequency of sound generated from the radiation sound generation panel.

11. A method of offsetting noise in a vehicle by controlling a motor mounted in the vehicle, the method comprising:

detecting, by a reference sensor, a noise source of the vehicle;

detecting, by an error sensor, information related to internal noise of the vehicle;

adjusting, by an adaptive control circuit connected to the reference sensor and the error sensor, a filter value for reducing the internal noise of the vehicle on a basis of detecting signals from the reference sensor and the error sensor and of generating a current instruction for driving the motor by applying the adjusted filter value;

controlling, by a motor controller connected to the adaptive control circuit and the motor, driving of the motor to follow the current instruction; and generating, by a radiation sound generator engaged to the motor, sound for offsetting the internal sound using vibration generated according to the driving of the motor.

12. The method of claim 11, wherein the error sensor is configured to detect and output information related to an error between noise by the noise source and the sound generated by the radiation sound generator.

13. The method of claim 11, wherein the adaptive control circuit includes:

an adaptive control filter configured of outputting a signal corresponding to the current instruction by filtering the detecting signal from the reference sensor; and a least mean square (LMS) controller configured of updating the filter value of the adaptive control filter on a basis of the detecting signal from the reference sensor and the detecting signal from the error sensor, the detecting signals being filtered by an estimation complementary filter configured of estimating a sound transfer function between the noise source and the error sensor.

14. The method of claim 11, wherein the motor controller includes at least one of a d-q converter converting 3-phase currents of the motor measured by a current sensor into d-axial and q-axial currents;

a d-q compensator compensating for d-axial and q-axial counter electromotive forces of the motor;

a voltage instruction generator configured of generating d-axial or q-axial voltage instruction for driving the motor on a basis of a d-axial or q-axial current instruction value input from the adaptive control circuit, d-axial and q-axial actual current values converted through the d-q converter, and a compensation value obtained through the d-q compensator;

a d-q inverse transformer converting a voltage instruction signal generated by the voltage instruction generator into three phases; and a pulse-width modulation (PWM) controller configured for controlling PWM signals on a basis of 3-phase voltage instruction signals converted by the d-q inverse transformer.

15. The method of claim 14, further including:

a position sensor configured for detecting a position of a rotor of the motor; and an angular speed extractor extracting an angular speed of the motor on a basis of a detected position of the rotor, wherein the d-q compensator is configured to compensate for the d-axial and q-axial counter electromotive forces of the motor on a basis of an angular speed of the motor extracted by the angular speed extractor, d-axial and q-axial inductances, d-axial and q-axial current instruction values, and magnetic flux of the motor.

16. The method of claim 14, wherein the PWM controller is space vector pulse width modulation (SVPWM) or sinusoidal pulse width modulation (SPWM).

17. The method of claim 14, further including:

an inverter connected to the PWM controller and including a plurality of switching elements and driving the motor by providing AC power to the motor by turning on or off the plurality of switching elements in a response to PWM signals output from the PWM controller.

18. The method of claim 11, wherein the motor is a motor-driven power steering (MDPS) motor which is connected to a steering wheel shaft mounted in the vehicle and assists a steering wheel to steer.

19. The method of claim 11, wherein the radiation sound generator includes:

a motor support structure connected to the motor and transmitting the vibration generated from the motor;

a mounting bracket fixing the motor support structure and receiving the vibration generated from the motor; and a radiation sound generation panel coupled to the mounting bracket and generating the sound using the vibration of the motor transmitted through the mounting bracket.

20. The method of claim 19, wherein the radiation sound generator further includes a frequency tuning structure attached to the radiation sound generation panel and adjusting a frequency of sound generated from the radiation sound generation panel.

* * * * *